US006098536A

United States Patent [19]

Ohkawa

[11] Patent Number: 6,098,536

[45] **Date of Patent: *Aug. 8, 2000**

[54] STENCIL PRINTER

[75] Inventor: Eiji Ohkawa, Watari-gun, Japan

[73] Assignee: Tohoku Ricoh Co., Ltd., Shibata-gun, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/025,037

[22] Filed: Feb. 18, 1998

[30] Foreign Application Priority Data

Jun. 3, 1997 [JP] Japan ..... 9-145518
Nov. 12, 1997 [JP] Japan ..... 9-310716

[51] Int. Cl.[7] ..... B41L 13/04

[52] U.S. Cl. ..... 101/118; 101/116; 271/10.03

[58] Field of Search ..... 101/114, 116, 101/117, 120, 127.1, 128.1, 129, 118; 271/10.03, 226, 245, 246, 247, 275

[56] References Cited

U.S. PATENT DOCUMENTS 4,911,069 3/1990 Hayama et al. .
5,415,387 5/1995 Suzuki .
5,931,090 8/1999 Ohkawa ..... 101/118

FOREIGN PATENT DOCUMENTS 5-305707 11/1993 Japan .
5-330225 12/1993 Japan .
6-20620 6/1994 Japan .
6-247586 9/1994 Japan .
8-332769 12/1996 Japan .
9-1914 1/1997 Japan .
9-216448 8/1997 Japan .

OTHER PUBLICATIONS

English translation of JP 5–330225.

*Primary Examiner*—Ren Yan
*Attorney, Agent, or Firm*—Oblon, Spivak, McClelland, Maier & Neustadt, P.C.

[57] ABSTRACT

A printer of the type wrapping a master around a print drum and pressing a sheet against the master with the print drum or a press drum is disclosed. A sheet clamper is arranged on the press drum. A timing sensing device for allowing the leading edge of the sheet to be fed toward the sheet clamper at a preselecting timing is arranged on the press drum or a member associated therewith. With this configuration, the printer causes the sheet clamper to surely clamp the leading edge of the sheet and prevents the sheet from rolling up. In addition, the printer feeds the sheet at a preselected timing with stability and reliability and thereby enhances accurate registration.

16 Claims, 13 Drawing Sheets

STENCIL PRINTER

BACKGROUND OF THE INVENTION

The present invention relates to a printer and, more particularly, to a stencil printer of the type wrapping a master around a print drum and pressing a sheet against the master with the print drum or a press drum.

Various kinds of sheet feeding devices have heretofore been proposed for use in a stencil printer of the type described. One of them uses a sector gear for feeding a sheet from the top of a stack loaded on a sheet tray to a gap between a print drum and a press roller. Another conventional sheet feeding device includes a press drum having substantially the same outside diameter as the print drum i n place of the press roller. The press drum is rotatable at substantially the same peripheral speed as the print drum, but in the opposite direction to the print drum, while clamping the leading edge of a sheet thereon. The press drum therefore forcibly separates the leading edge of the sheet, or printing, from the print drum. With this kind of press drum, it is possible to obviate an occurrence that the leading edge of the sheet is not peeled off by a peeler, causing the sheet to roll up and jam. It is also possible to reduce noise and to enhance accurate positioning of an image on the sheet in the direction of sheet transport (registration accuracy).

The conventional sector gear scheme and press drum scheme each has some problems left unsolved, as follows. The sector gear scheme cannot maintain the positional accuracy or registration accuracy in the direction of sheet transport, and needs a main motor whose output power is great enough to withstand a heavy load, as will be discussed more specifically later. The press drum scheme is not practicable without resorting to a drive transmission system between the print drum and the press drum and involving a top-down adjusting mechanism made up of a number of parts, as taught in, e.g., Japanese Patent Laid-Open Publication No. 9-216448. This, coupled with the fact that the above drive transmission system has a substantial length to a main motor, disturbs the timing for the sheet to be driven from a registration roller toward a sheet clamper provided on the press drum, lessening the effect of the press drum scheme. The disturbance is ascribable to backlash particular to a gear train included in the top-bottom adjusting mechanism and the slackening or stretching of a timing belt. As a result, the sheet is caused to roll up, as stated earlier.

Technologies relating to the present invention are also disclosed in, e.g., Japanese Patent Laid-Open Publication Nos. 5-330225, 8-332769, 9-1914, 5-305707 and 6-247586, Japanese Utility Model Publication No. 6-20620, and U.S. Pat. Nos. 5,415,387 and 4,911,069.

SUMMARY OF THE INVENTION

It is therefore an object of the present invention to provide a printer capable of causing a sheet clamper to surely clamp the leading edge of a sheet and prevent it from rolling up, and insuring a stable and reliable sheet feed timing and therefore high registration accuracy.

It is another object of the present invention to provide a printer promoting easy control using software.

It is still another object of the present invention to provide an inexpensive printer operable with a main motor outputting a minimum of power.

It is a further object of the present invention to provide a printer capable of feeding, taking account of the slippage of a sheet on a registration roller, the leading edge of the sheet at a timing matching with an angular position of a sheet clamper without regard to the kind of the sheet.

In accordance with the present invention, a printer for printing an image on a sheet by pressing it against a master includes a print drum for wrapping the master therearound. A press drum has substantially the same outside diameter as the print drum for pressing the sheet relatively against the print drum. The press drum includes a sheet clamper for clamping the leading edge of the sheet. A timing sensing device determines a timing for the leading edge of the sheet to be fed toward the sheet clamper.

Also, in accordance with the present invention, a printer for printing an image on a sheet by pressing it against a master includes a print drum for wrapping the master therearound. A press drum has substantially the same outside diameter as the print drum for pressing the sheet relatively against the print drum. The press drum includes a sheet clamper for clamping the leading edge of the sheet. A registration roller feeds the leading edge of the sheet toward the sheet clamper. A sheet feed timing sensing device determines a timing for the leading edge of the sheet to be fed toward the registration roller.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENT

Figure 1:
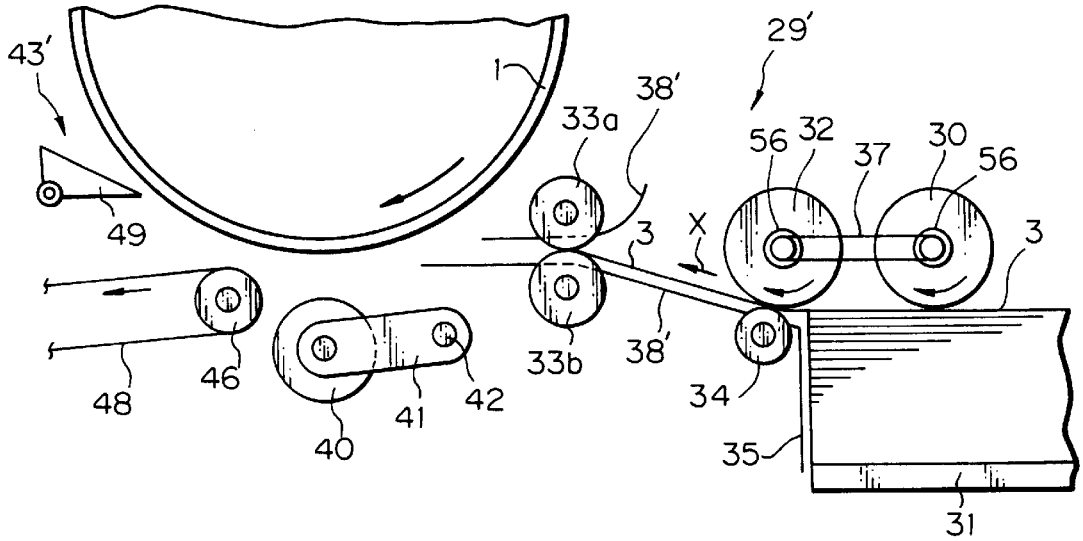
Fig. 1 PRIOR ART
FIG. 1 is a front view showing the construction of a sheet feeding device included in a conventional stencil printer, and how a feed roller feeds a sheet at the start-up of operation.

To better understand the present invention, brief reference will be made to a conventional stencil printer, shown in FIG. 1. As shown, the stencil printer includes a sheet feeding device 29'. The sheet feeding device 29' includes an elevatable sheet tray 31 loaded with a stack of sheets 3. A pick-up roller 30 and a feed roller 32 are journalled to opposite side walls not shown. A reverse roller 34 is pressed against the feed roller 32 in order to prevent two or more of the sheets 3 from being fed together. A pair of registration rollers 33*a* and 33*b* drive the leading edge of the sheet 3 fed from the sheet tray 31 to a gap between a print drum 1 and a press roller or pressing means 40 at a preselected timing. The print drum 1 is implemented as a porous hollow cylinder. A pair of guides 38' guide the leading edge of the sheet 3 toward the gap between the print drum 1 and the press roller 40 via the registration rollers 33*a* and 33*b*.

The sheet tray 31 is elevatable such that the sheet 3 on the top of the stack remains in contact with the pick-up roller 30 under a preselected pressure which allows the sheet 3 to be paid out. A front wall 35 stands upright at the left end of the tray 31, as viewed in FIG. 1. The sheets 3 are positioned on the tray 31 with their leading edges abutting against the front wall 35.

The pick-up roller 32 is rotated clockwise, as viewed in FIG. 1, by a cam, not shown, rotatable in synchronism with the print drum 1, a sector gear having a cam follower contacting the cam, and a pick-up roller gear meshing with the sector gear and having a one-way clutch built therein. An endless belt 37 connects the pick-up roller 30 and feed roller 32 and transmits the rotation of the latter to the former.

Figure 6:
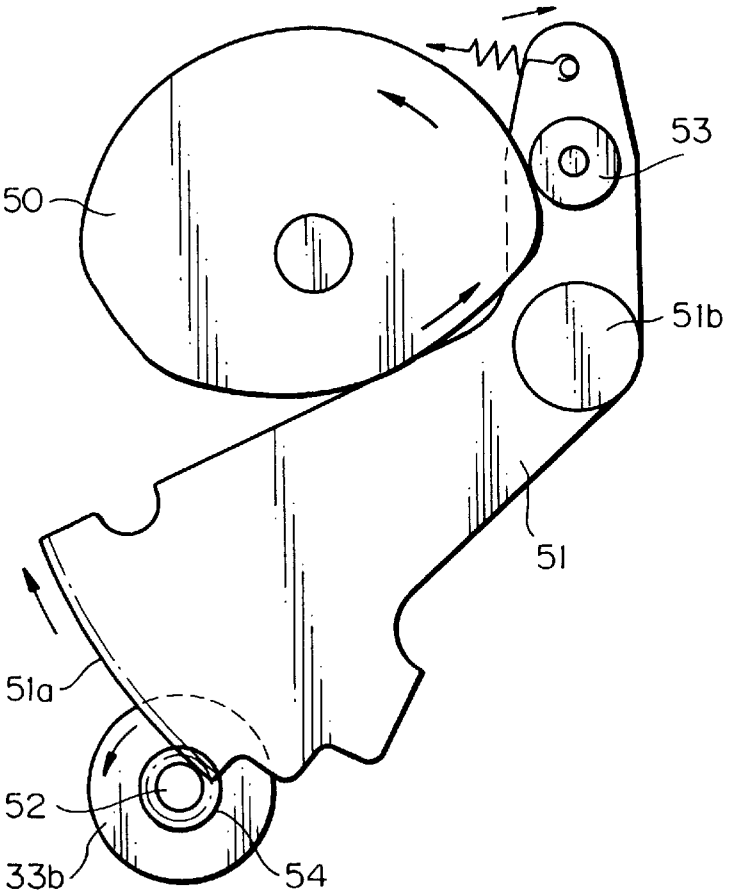
Fig. 6 PRIOR ART
FIGS. 5 and 6 are front views showing a specific configuration of a drive mechanism included in the conventional sheet feeding device, and the operation of the drive mechanism.
Figure 5:
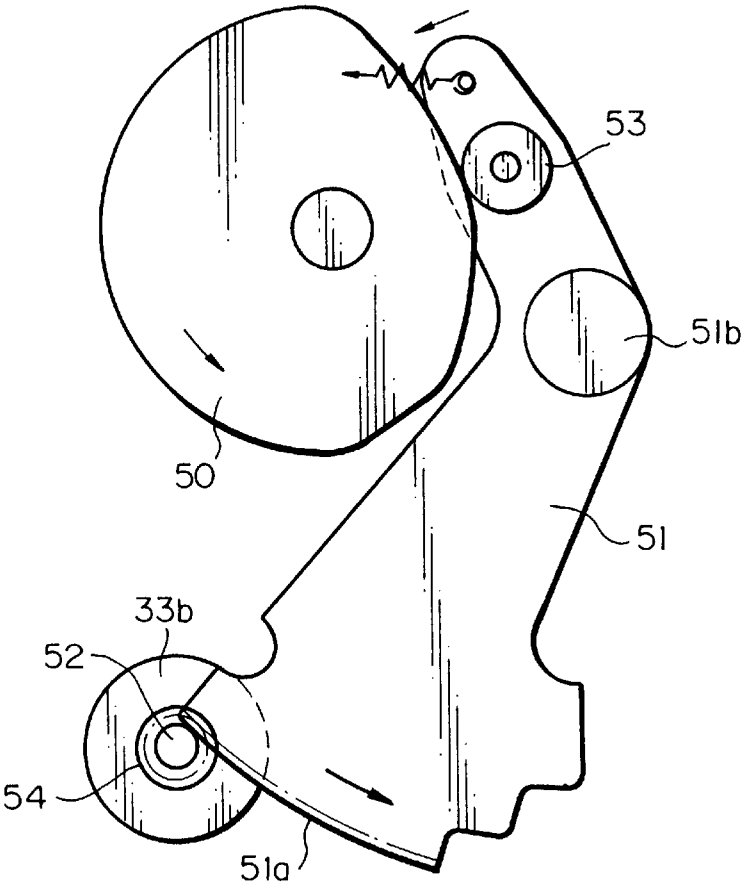
Fig. 5 PRIOR ART

The registration rollers 33*a* and 33*b* are journalled to the side walls at a position downstream of the reverse roller 34 in a direction X in which the sheets 3 are conveyed. The registration rollers 33*a* and 33*b* are driven in the same manner as the feed roller 32. Specifically, as shown in FIGS. 5 and 6, the lower registration roller 33*b* is rotated counterclockwise by a cam 50, a sector 51 rotatable about a shaft 51*b*, a cam follower 53 positioned on one end of the sector 51 and engaged with the cam 50, a sector gear 51*a* formed on the other end of the sector 51, and a registration roller gear 54 meshing with the sector gear 51*a* and having a one-way clutch 52 thereinside. The registration rollers 33*a* and 33*b* are caused to convey the sheet 3 at a speed equal to the peripheral speed of the print drum 1. The sheet feed system using the above members including the sector gear 51*a* is the sector gear scheme stated earlier.

Referring again to FIG. 1, the press roller 40 is positioned below the print drum 1 and movable into and out of contact with the drum 1 with the intermediary of a master 2. The press roller 40 is rotatably supported by the one end of a pair of roller arms 41 (only one is visible). The other end o f each roller arm 41 is fixed to a shaft 42 which is journalled to the side walls mentioned previously. A cam or similar drive member, not shown, is mounted on one end of the shaft 42 and causes the free ends of the roller arms 41 to move in matching relation to the rotation of the print drum 1.

A sheet discharging device 43' is arranged at the left-hand side and below the print drum 1, as viewed in FIG. 1. The sheet discharging device 43' includes a peeler 49, a conveyor belt 48, and a roller 46 over which the belt 48 is passed. The peeler 49 is rotatable so as to peel off the leading edge of the sheet 3 adhered to the master 2 due to the adhesion of ink. The belt 48 and roller 46 cooperate to convey the sheet or printing 3 separated from the master 2 by the peeler 49 to a printing tray, not shown, while retaining it on the belt 48.

Figure 2:
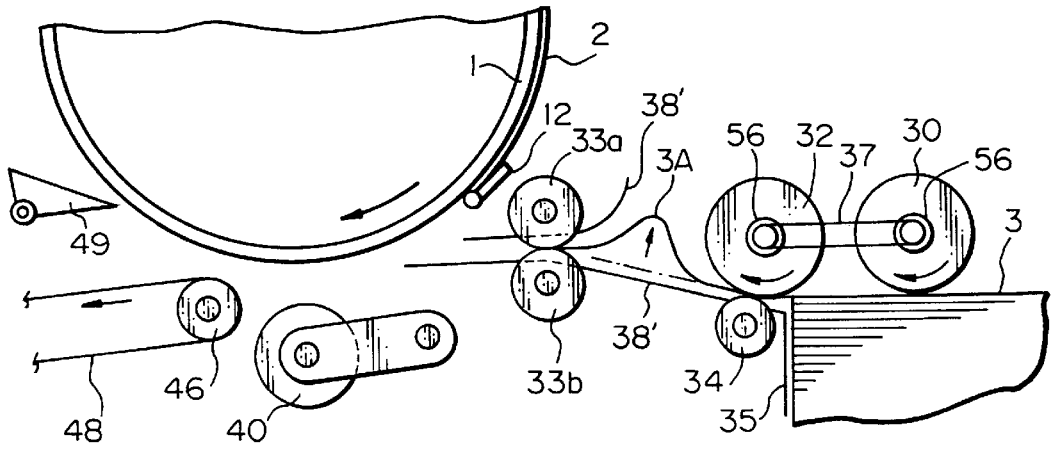
Fig. 2 PRIOR ART
FIG. 2 shows how the conventional sheet feeding device causes the sheet to form a slack between the feed roller and a registration roller.
Figure 4:
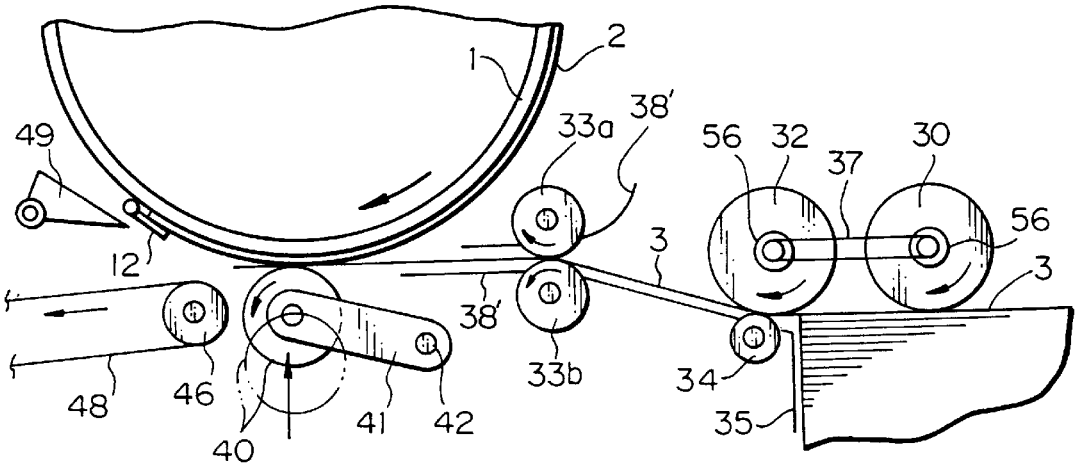
Fig. 4 PRIOR ART
FIG. 4 is a front view demonstrating the transport of the sheet occurring in the conventional stencil printer at the initial stage of printing operation.

How the sheet 3 is conveyed in the above arrangement will be described. As shown in FIG. 1, while the pick-up roller 30 pays out the top sheet 3 from the sheet tray 31, the feed roller 32 and reverse roller 34 separate the top sheet 3 from the underlying sheets 3. As a result, only the top sheet 3 is fed toward the registration rollers 33*a* and 33*b*. The leading edge of the sheet 3 abuts against the nip between the registration rollers 33*a* and 33*b*. As shown in FIG. 2, the sheet 3 forms a curved slack 3A as the conveyance proceeds. At this time, the rotation of the pick-up roller 30 and feed roller 32 is interrupted. Subsequently, the cam 50, FIGS. 5 and 6, causes the registration rollers 33*a* and 33*b* to start rotating at a preselected timing. As a result, the slack 3A of the sheet 3 disappears. While the pick-up roller 30 and feed roller 32 rotate by following the movement of the sheet 3 via one-way clutches 56, the sheet 3 is conveyed to the gap between the print drum 1 and the press roller 40. As shown in FIG. 4, as soon as the leading edge of the sheet 3 is brought to the gap between the print drum 1 and the press roller 40, the roller 40 is lifted so as to press the sheet 3 against the drum 1. In this condition, an image is printed on the sheet 3 by a procedure well known in the art.

Figure 3:
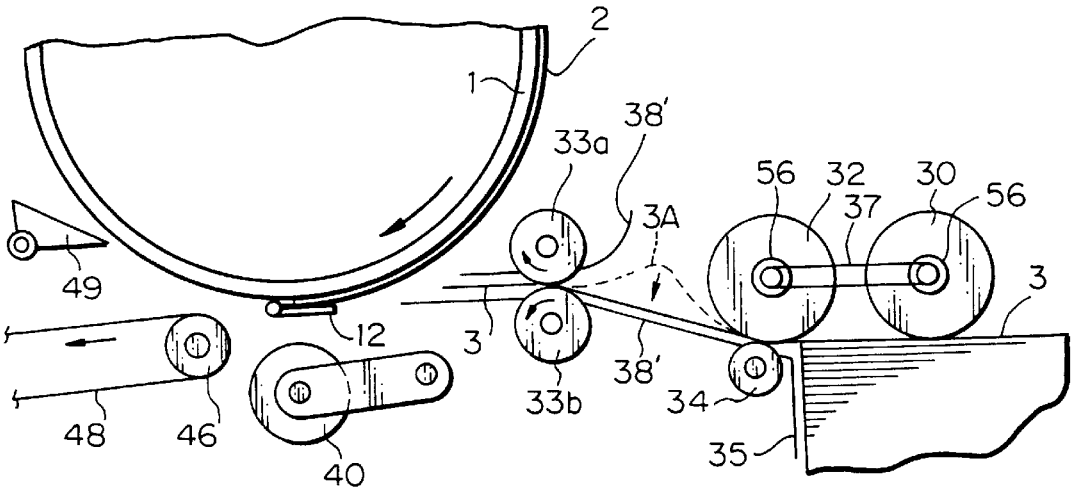
Fig. 3 PRIOR ART
FIG. 3 demonstrates how the registration roller of the conventional stencil printer conveys the sheet just after it has been driven.

The problems with the conventional sector gear scheme described above are as follows. While the sheet 3 is conveyed from the position shown in FIG. 3 to the position shown in FIG. 4, the pick-up roller 30 and feed roller 32 each exerts a load on the sheet 3 although simply following the movement of the sheet 3. In addition, because the reverse roller 34 does not rotate, it also exerts a load on the sheet 3. As a result, the sheet 3 slips at the nip between the registration rollers 33*a* and 33*b* because the leading edge of the sheet 3 is free. This lowers the positional accuracy or registration accuracy of the sheet 3 in the direction of sheet transport X.

As shown in FIG. 1, a spring, not shown, constantly biases the registration rollers 33*a* and 33*b* in order to stop the leading edge of the sheet 3 at the nip between the rollers 33*a* and 33*b* for a moment. In addition, to maintain the rollers 33 and 33*b* unmovable until the arrival of the next sheet 3, brake is applied to the mechanism for driving the lower or drive roller 33*b*. This allows the rollers 33*a* and 33*b* to stop rotating just after the reciprocating movement of the sector gear 51*a*. However, because the cam 50 for moving the sector gear 51*a* is driven by a main motor associated with the print drum 1, the brake applied to the rollers 33*a* and 33*b* increases the load on the main motor. The main motor is therefore required to output great power. The registration rollers 33*a* and 33*b* is, in principle, expected to convey the sheet 3 by a constant amount without regard to the quality or thickness of the sheet 3 because the amount is determined by the profile of the cam 50. In practice, however, the coefficient of friction of the sheet 3 depends on the quality and thickness of the sheet 3. As a result, the sheet 3 slips on the rollers 33*a* and 33*b* and cannot be conveyed by a constant amount, resulting in low registration accuracy in the direction of sheet transport X.

Figure 7:
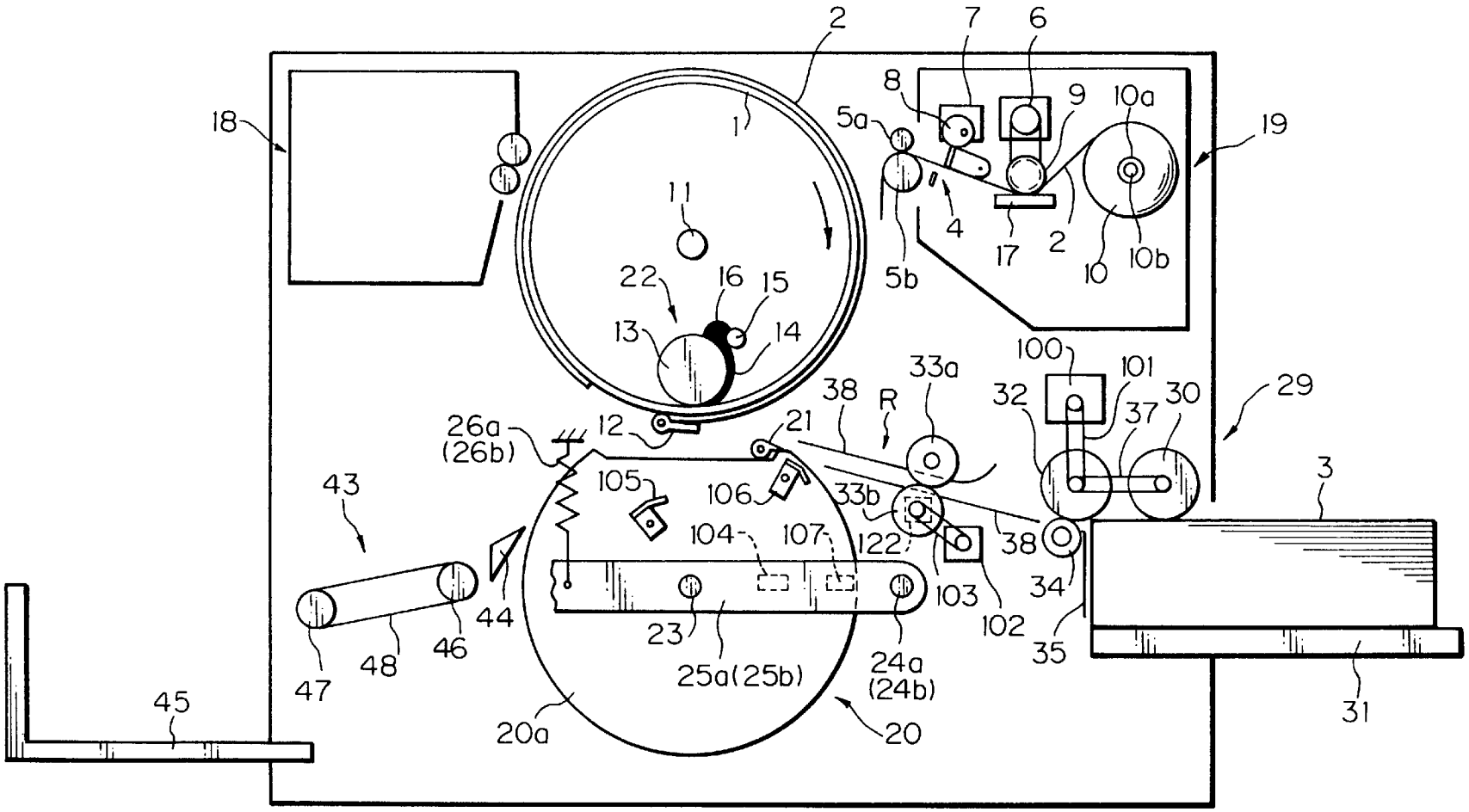
FIG. 7 is a front view showing a stencil printer embodying the present invention.

Referring to FIG. 7, a stencil printer embodying the present invention will be described. As for members provided in pairs, only one of them will be described except when distinction is necessary in order to simplify the description. As shown, the stencil printer includes a hollow cylindrical print drum 1 for wrapping a perforated stencil or master 2 therearound. A master making device 19 is positioned at the right-hand side of the print drum 1, as viewed in FIG. 7, in order to make a master by perforating, or cutting the stencil 2. An ink feeding device 22 is arranged in the print drum 1 for feeding ink to the master 2 wrapped around the drum 1. A press drum 20 is positioned below the print drum 1 in order to press a sheet 3 against the master 2 wrapped around the drum 1. For this purpose, the press drum 20 is provided with a sheet clamper or clamping means 21 for clamping the leading edge of the sheet 3 conveyed thereto. A sheet feeding device 29 is located at the right-hand side of the press drum 20, as viewed in FIG. 7, in order to feed the sheet 3 toward the sheet clamper 21. A sheet discharging device 43 is arranged at the left-hand side of the press drum 20.

Figure 8:
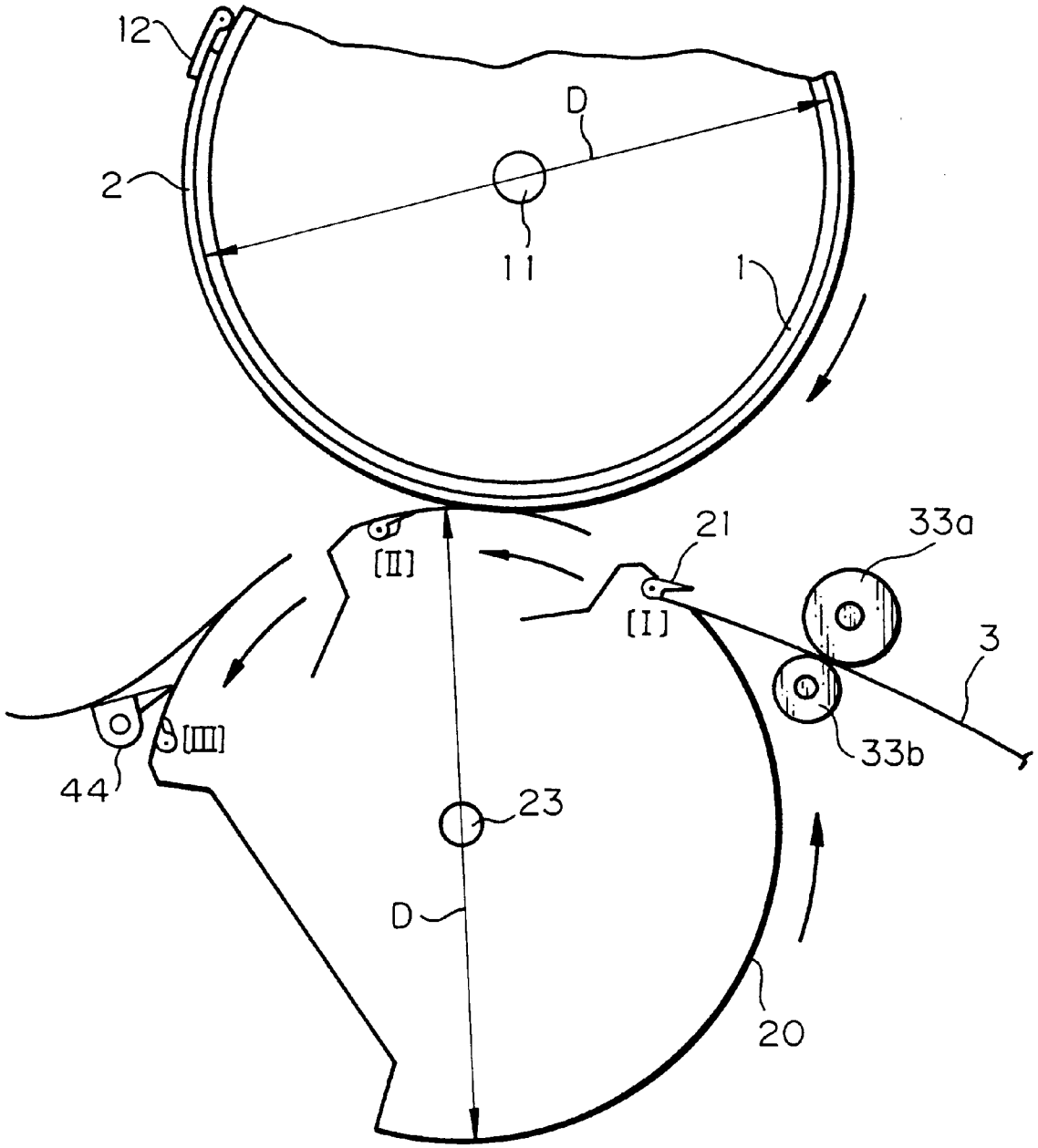
FIG. 8 is a front view showing consecutive angular positions of a sheet clamper occurring in the illustrative embodiment in accordance with the rotation of a press drum, and how a sheet is conveyed.

As shown in FIGS. 7 and 8, the print drum 1 is made up of a porous hollow cylinder and a laminate of mesh screens, not shown, wrapped around the hollow cylinder. The print drum 1 is rotatably mounted on a tubular shaft 11 and driven by a DC motor or similar main motor, not shown, via a drive transmission mechanism, not shown. In the illustrative embodiment, the rotation of the main motor is not transferred to a sheet feed drive mechanism, as will be described specifically later. This allows the main motor smaller in size than the conventional main motor to be used. A master clamper 12 is mounted on the outer periphery of the print drum 1 in order to clamp the leading edge of the master 2 output from the master making device 19.

The master clamper 12 faces a stage, not shown, fixed on the print drum 1 and extending along a line parallel to the axis of the drum 1. The stage is formed of a ferromagnetic material. The master clamper 12 is rotatable toward and away from the stage and provided with a magnet on its surface facing the stage. When the print drum 1 is brought to a preselected angular position, an opening/closing device, not shown, causes the master clamper 12 to open or close.

The master making device 19 includes a support shaft 10*b*. The stencil 2 is wound round a core 10*a* in the form of a roll 10 and supported by the support shaft 10*b* such that it can be paid out from the roll 10. A platen roller 9 conveys t h e stencil 2. A thermal head 17 is movable into and out of contact with the platen roller 9. A pair of cutter members 4 are arranged one above the other at a position downstream of the platen roller 9 in the direction in which the stencil 2 is conveyed. Rollers 5*a* and 5*b* are provided in a pair for conveying the leading edge of the stencil 2 toward the master clamper 12.

The platen roller 9 has its shaft rotatably supported and is driven by a stepping motor 6 at a preselected peripheral speed. The platen roller 9 in rotation conveys the stencil 2 while pressing it against the thermal head 17. The thermal head 17 has a plurality of heating elements arranged in an array in the widthwise direction of the stencil 2. The head 17 is movable into and out of contact with the platen roller 9 by being driven by a conventional mechanism, not shown. A digital image signal representative of a document image is processed by an analog-to-digital converter and a master making controller included in a document reading section, not shown. The head 17 selectively perforates the stencil 2 in accordance with the digital image signal to thereby form an image in the stencil 2.

The upper cutter member 4 is moved up and down by an eccentric cam 8 in order to cut the stencil 2 at a preselected length. The eccentric cam 8 is rotated by a cutter motor 7.

The ink feeding device 22 includes an ink roller 13 rotatable in synchronism with and in the same direction as the print drum 1 for feeding ink to the inner periphery of the print drum 1. A doctor roller 15 is positioned in parallel with the ink roller 13 and spaced from the roller 13 by a small gap, forming an ink well 16 between it and the roller 13. The ink is fed to the ink well 16 via the tubular shaft 11. The ink roller 13 and doctor roller 15 are journalled to opposite side walls, not shown, affixed to the tubular shaft 11. Because the print drum 1 and ink roller 13 are spaced by a small gap, the ink fed from the ink well 16 to the periphery of the roller 13 is transferred to the inner periphery of the print drum 1. An ink pack, not shown, is located at a suitable position. The ink is fed under pressure from the ink pack to the tubular shaft 11 by an ink pump, not shown, and dropped from the shaft 11 to the ink well 16 via holes formed in the shaft 11.

In the illustrative embodiment, the pressing means is implemented by the press drum 20 having the sheet clamper 21 and capable of enhancing the registration accuracy of the sheet 3, as stated in relation to the background art. As shown in FIG. 8, the press drum 20 has an outside diameter D equal to the outside diameter D of the print drum 1, so that the drum 20 completes one rotation at the same time as the drum 1. This allows the sheet clamper 21 to be mounted on the press drum 20. By feeding the sheet 3 while causing its leading edge to abut against the clamper 21, it is possible to enhance the registration accuracy of the sheet 3.

FIG. 8 shows various consecutive angular positions [I], [II] and [III] of the press drum 20. In the position [I] (sometimes referred to as a clamping position hereinafter), the sheet clamper 21 is closed after the leading edge of the sheet 3 has abutted against it. The clamper 21 clamping the sheet 3 is sequentially moved from the position [I] to the position [III] (sometimes referred to as an unclamping position hereinafter) via the position [II]. In the position [III], the clamper 21 is opened so as to release the sheet 3. That is, the leading edge of the sheet 3 is released from the clamper 21 at a position past the position [II] where the ink is transferred to the sheet 3. This derives another advantage that the sheet 3 is prevented from wrapping around the print drum 1 due to the adhesion of the ink.

As shown in FIG. 7, the press drum 20 has opposite end plates 20*a* (only one is visible) affixed to a shaft 23. A pair of arms 25*a* and 25*b* (only one is visible) are arranged on opposite ends of the press drum 20. The shaft 23 is journalled to the arms 25*a* and 25*b* via bearings, not shown, at opposite ends thereof. In this configuration, the press drum 20 is rotatable via the shaft 23. A shaft or fulcrum 24*a* is mounted on one of opposite side walls, not shown, of the printer body and supports one end of the arm 25*a* via a bearing. One end of the other arm 25*b* is supported by a shaft or fulcrum 24*b* rotatably supported by the other side wall via a bearing, not shown. The shafts 24*a* and 24*b* are aligned with each other.

A drive gear, not shown, is mounted on the inner end of the shaft 24*b* in order to cause the press drum 20 to rotate. A driven gear, not shown, is mounted on the shaft 23 and held in mesh with the drive gear. A toothed pulley, not shown, is mounted on the outer end of the shaft 24*b* in order to transfer the rotation of the print drum 1. Another toothed pulley, not shown, is mounted on one end plate of the print drum 1. A toothed belt, not shown, is passed over these toothed pulleys. A pulley is mounted on the above end plate of the print drum 1 coaxially with the pulley mounted on the print drum 1. In this configuration, the rotation of the main motor is transmitted to the above pulley via a belt and then transmitted to the driven gear of the shaft 23 via the toothed belt passed over the toothed pulleys, and drive gear. As a result, the press drum 20 is rotated counterclockwise at the same peripheral speed as the print drum 1 such that it presses itself against the print drum 1 at the same position at all times.

The circumferential surface of the press drum 20 is made up of a cylindrical portion capable of contacting the print drum 1, and a generally D-shaped recess portion for preventing the press drum 20 from conflicting with the master clamper 12. The sheet clamper 21 is positioned in the recess portion of the press drum 20 and has one end thereof affixed to a shaft. A spring, not shown, constantly biases the sheet clamper 21 in the closing direction. A cam, not shown, causes the sheet clamper 21 to open and receive the leading edge of the sheet 3 at a preselected timing, and then close to clamp the sheet 3. As a result, the sheet 3 is retained on the periphery of the drum 20.

Moving means moves the press drum 20 into and out of contact with the print drum 1. The moving means is implemented mainly by the arms 25*a* and 25*b* stated earlier, a pair of cam followers, not shown, respectively rotatably supported by the other ends of the arms 25*a* and 25*b*, a pair of springs 26*a* and 26*b* respectively constantly biasing the arms 25*a* and 25*b* toward the print drum 1, and a pair of cams, not shown, respectively selectively contacting the cam followers.

The cams provided in a pair, as stated above, are connected to the print drum 1 and main motor by toothed belts, not shown, so as to rotate in synchronism with the print drum 1. The cams have such a profile that at the time o f defective sheet transport or during master making operation, the cams slidingly contact the associated cam followers at a preselected timing in order to release the press drum 20 from the print drum 1, but in the other conditions they do not contact the cam followers in order to cause the press drum 20 clamping the sheet 3 to contact the print drum 1 under the action of the springs 26*a* and 26*b*. In this manner, the press drum 20 is angularly movable about the shafts 24*a* and 24*b* between the position where it is pressed against the drum 1 and the position where it is spaced from the drum 1 in accordance with the rotation of the cams.

The springs 26*a* and 26*b* having the above function are respectively anchored to the arms 25*a* and 25*b*, so that the press drum 20 can be pressed evenly against the print drum 1.

When defective sheet transport occurs, a cancelling mechanism, not shown, cancels the bias acting on the press drum 20 in order to prevent the press drum 20 from moving into contact with the print drum 1.

The drive mechanism including the main motor and the moving mechanism may be implemented by mechanisms shown in FIGS. 1–5 of Laid-Open Publication No. 9-216448 mentioned earlier.

A master discharging device 18 is located at the left-hand side of the print drum 1, as viewed in FIG. 7. The master discharging device 18 peels off and collects a used master 2 wrapped around the print drum 1.

The sheet discharging device 43 is identical with the conventional sheet discharging device 43', FIG. 1, except that a separator 44 for separating and guiding the sheet or printing 3 is substituted for the peeler 49. The device 43 has, in addition to the separator 44, a belt 48 passed over an inlet roller 46 and an outlet roller 47 for conveying the sheet 3 separated by the separator 44, and a suction fan, not shown. The belt 48 is driven at a speed higher than the peripheral speed of the print drum 1 by a mechanism including a motor. A printing tray 45 is positioned at the left-hand side of the device 43, as viewed in FIG. 7, for stacking the sheets 3 sequentially driven out of the printer.

The sheet feeding device 29 is similar to the conventional sheet feeding device 29' except for the following. The conventional sector gear scheme for driving the feed roller 32 is replaced with an independent drive system including an exclusive stepping motor 100 independent of the main motor. Also, the conventional sector gear scheme for driving the registration rollers 33*a* and 33*b* is replaced with an independent drive system including an exclusive stepping motor 102 independent of the main motor. Further, the conventional guide plates 38' are replaced with a pair of guide plates 38 which guide the leading edge of the sheet 3 to the sheet clamper 21 of the press drum 20.

In the illustrative embodiment, the registration rollers 33*a* and 33*b* drive the leading edge of the sheet 3 at a preselected timing toward the clamper 21 of the press drum 20 brought to the preselected angular position.

The stepping motor 100 plays the role of feed roller drive means for causing the feed roller 32 to rotate. Specifically, a drive pulley is mounted on the output shaft of the stepping motor 100. A toothed endless belt 101 is passed over the drive pulley and a driven pulley mounted on the shaft of the feed roller 32. The stepping motor 100 causes the feed roller 32 to rotate clockwise via the above driveline. A one-way clutch, not shown, is built in each of the shafts of the feed roller 32 and pick-up roller 30, allowing each of the rollers 32 and 30 to rotate only in the clockwise direction.

The stepping motor 102 serves as registration roller drive means for causing the lower registration roller 33*b* to rotate. Specifically, a toothed endless belt 103 is passed over a drive pulley mounted on the output shaft of the stepping motor 102 and a driven pulley mounted on the shaft of the registration roller 33*b*. The stepping motor 102 causes the registration roller 33*b* to rotate counterclockwise via the above driveline.

A sheet feed control system included in the illustrative embodiment will be described with reference to FIGS. 7–10. As shown in FIG. 7, interrupters 105 and 106 are fastened to the outer surface of the front end plate 20*a* of the press drum 20 and spaced in each of the radial and circumferential directions of the press drum 20 by a preselected distance. The interrupters 105 and 106 each is formed of sheet metal or synthetic resin and generally L-shaped, as seen in a front view and a side elevation, such that its end protrudes toward the front.

Photosensors 104 and 107 are fastened to the inner surface of the arm 25*a* and spaced by a preselected distance in the radial direction of the press drum 20. The photosensors 104 and 107 are conventional transmission type sensors each having a light emitting portion and a light-sensitive portion.

The interrupter 105 and photosensor 104 are positioned such that the former interrupts the optical path of the latter only when the press drum 20 is rotated counterclockwise to a preselected position. The interrupter 105 and photosensor 104 play the role of sheet feed timing sensing means for causing the leading edge of the sheet 3 to be fed toward the registration rollers 33*a* and 33*b* at a preselected timing. The interrupter 105 is positioned on the end plate 20*a* of the press drum 20 such that when the trailing edge of a sheet 3 of size A3 moves away from the nip between the registration rollers 33*a* and 33*b*, the interrupter 105 meets the photosensor 104. In response to the resulting ON signal output from the photosensor 104, the stepping motor 100 is energized in order to rotate the feed roller 32.

Likewise, the interrupter 106 and photosensor 107 are positioned such that the former interrupts the optical path of the latter only when the press drum 20 is rotated counterclockwise to a preselected position. The interrupter 106 and photosensor 107 serve as timing sensing means for causing the leading edge of the above sheet 3 to be fed toward the clamper 21 of the press drum 20 at a preselected timing. Assume the distance on the sheet transport path, labeled R, between the nip between the registration rollers 33*a* and 33*b* and the position where the leading edge of the sheet abuts against the sheet clamper 21, and the circumferential distance of the press drum 20 between the position where the interrupter 106 meets photosensor 107 and the sheet clamper 21 against which the leading edge of the sheet 3 has abutted. Then, the interrupter 106 is positioned on the end plate 20*a* such that the above two distances coincide with each other.

Figure 9:
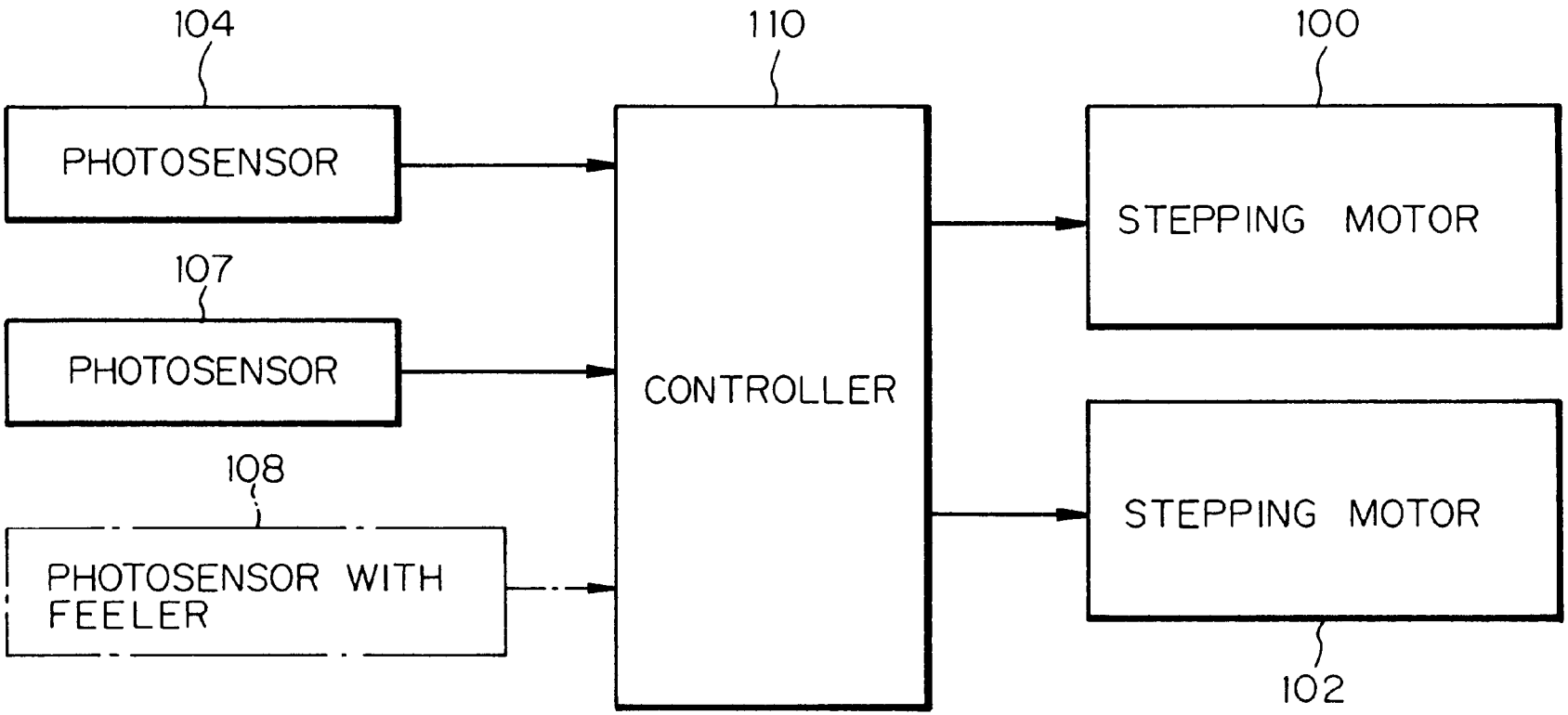
FIG. 9 is a block diagram schematically showing a sheet feed control system included in the embodiment.

As shown in FIG. 9, the control system includes a controller 110 for controlling the sheet feed and implemented as a microcomputer. The microcomputer includes a CPU (Central Processing Unit), an I/O (Input/Output) port, a ROM (Read Only Memory), a RAM (Random Access Memory) and a timer connected together by a signal bus, although not shown specifically. While the control system includes a photosensor 108 with a feeler, as indicated by a dash-and-dot line, the photosensor 108 is not used in the illustrative embodiment.

The CPU of the controller 110 (sometimes simply referred to as controller 110 hereinafter) is electrically connected to the photosensor 104 via the input port and receives its output for controlling stepping motor 100. Also, the controller 110 is electrically connected to the photosensor 107 via the input port and receives its output for controlling the stepping motor 102.

Further, the controller 110 is electrically connected to the stepping motor 100 via the output port. In response to the output of the photosensor 104, the controller 110 drives the stepping motor 100 in order to feed the leading edge of the sheet 3 toward the registration rollers 33*a* and 33*b*. In this sense, the controller 110 plays the role of feed roller drive control means. In addition, the controller 110 is electrically connected to the stepping motor 102 via the output port. In response to the output of the photosensor 107, the controller 110 drives the stepping motor 102 in order to feed the leading edge of the sheet 3 at the same time as the clamper 21 of the press drum 20 is brought to its clamping position. The controller 110 therefore plays the role of registration roller drive control means at the same time.

Figure 10:
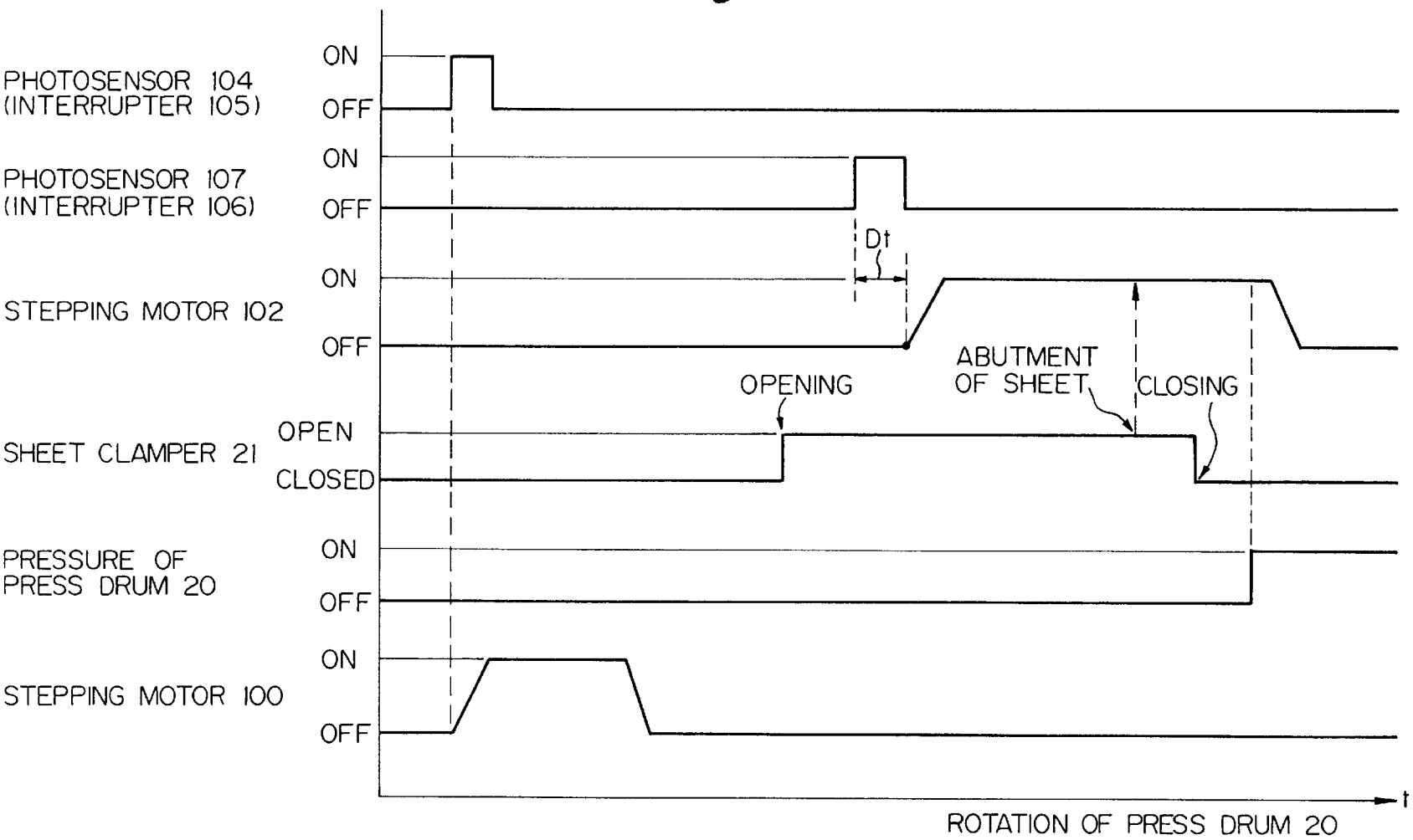
FIG. 10 is a timing chart demonstrating a sheet feed procedure particular to the embodiment.

A program representative of a procedure shown in FIG. 10 and determined beforehand by, e.g., experiments is stored in the ROM of the controller 110. The RAM of the controller 110 is used to temporarily store the results of calculations output from the CPU and to store the outputs of the photosensors 104 and 107, as needed.

The operation of the illustrative embodiment will be described hereinafter. The operator sets a document on the document reading section and then presses a start button, not shown. In response, the print drum 1 starts rotating, and the master discharging device 18 peels off a used master wrapped around the print drum 1 and discards it. The print drum 1 is brought to a stop at its master feed position where the master clamper 12 is positioned at substantially the rightmost side of the print drum 1. Then, the shaft of the master clamper 12 is rotated in order to open the clamper 12 away from the stage. In this condition, the print drum 1 waits for the stencil or master 2.

Subsequently, the stepping motor 6 is energized with the result that the platen roller 9 starts rotating while paying out the stencil 2 from the roll 10. In the document reading section, a scanner, not shown, sequentially scans the document while outputting an image signal. The image signal is processed by the previously mentioned analog-to-digital converter and master making controller to turn out a digital image signal. The heating elements of the thermal head 17 are selectively energized in accordance with the digital image signal, selectively perforating the stencil 2.

The platen roller 9 conveys the leading edge of the stencil 2 toward the master clamper 12 which is held in its open position. When the stepping motor 6 reaches a preselected number of steps, the shaft of the master clamper 12 is rotated to close the clamper 12. As a result, the leading edge of the perforated part of the stencil or master 2 is clamped by the master clamper 12.

At the same time as the above clamping operation, the print drum 1 and press drum 20 each is caused to rotate at a peripheral speed substantially equal to the stencil conveying speed. Consequently, the master 2 is sequentially wrapped around the print drum 1. When the master 2 is wrapped around the print drum 1 over a preselected length, the rotation of the print drum 1, press drum 2 and platen roller 9 is interrupted. At the same time, the cutter motor 7 is driven to lower the upper cutter member 4 via the eccentric cam 8, thereby cutting off the trailing edge of the master 2. Then, the print drum 1 is again rotated clockwise, pulling the trailing edge of the master 2 out of the master making device 19. In this manner, the master 2 is fully wrapped around the print drum 1.

Figure 11:
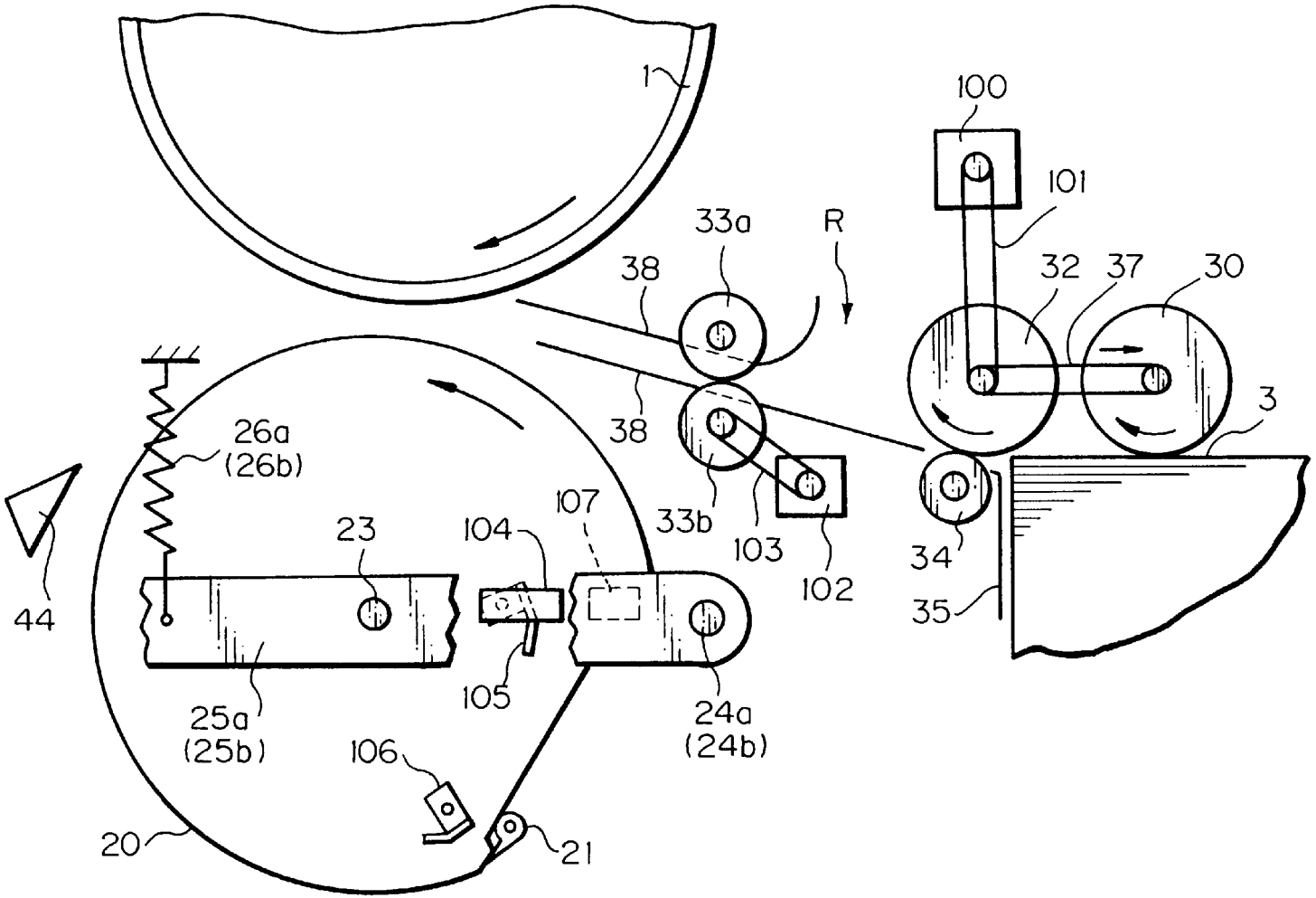
FIG. 11 is a front view showing how a feed roller included in the embodiment feeds a sheet just after it has been driven.
Figure 12:
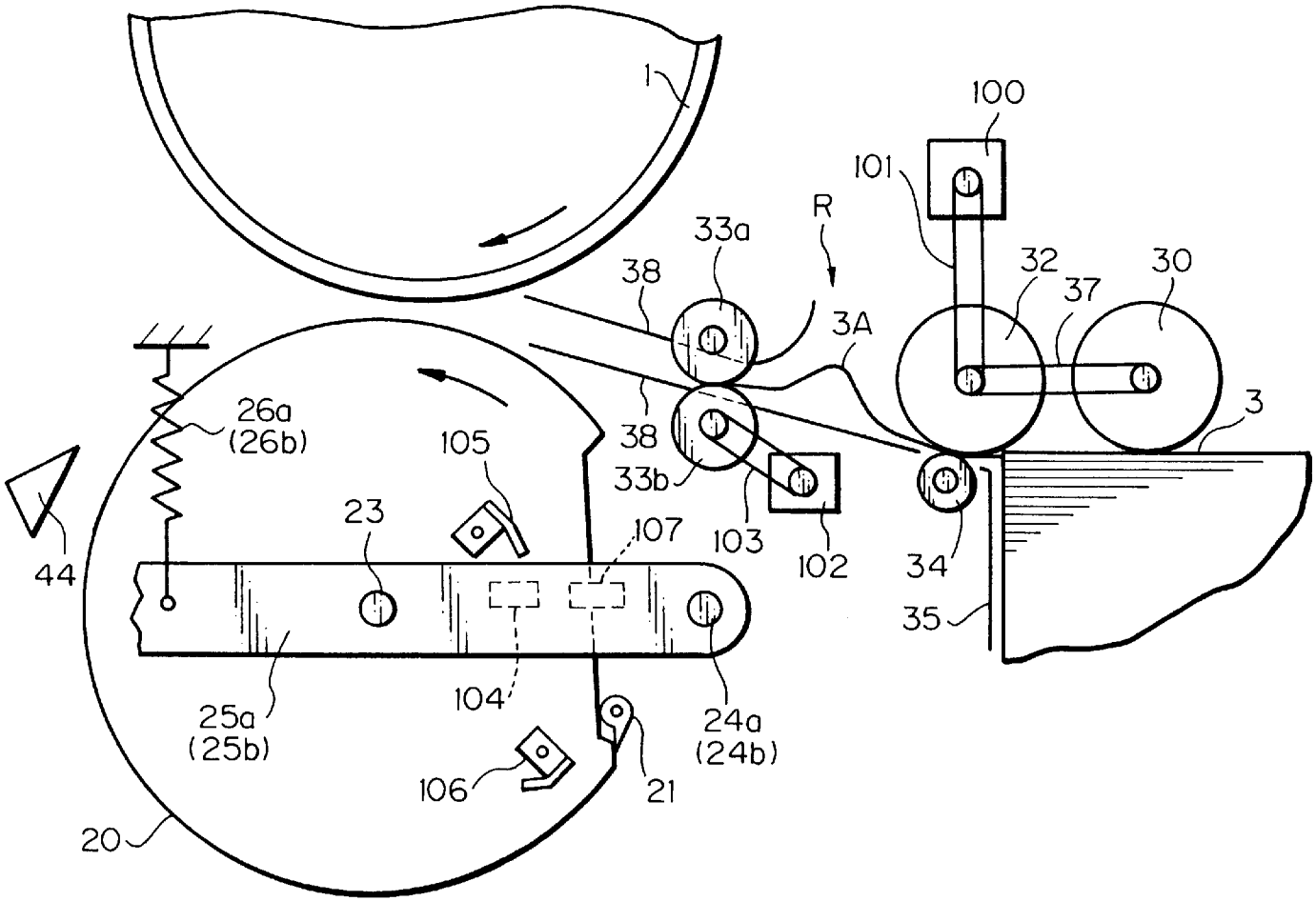
FIG. 12 is a front view showing how the embodiment causes the sheet to form a slack between the feed roller and a registration roller.

How the sheet 3 is conveyed will be described more specifically with reference to FIGS. 7–15. As shown in FIG. 11, when the press drum 20 is rotated counterclockwise until the interrupter 105 meets the photosensor 104, the photosensor 104 sends its ON signal to the controller 110. In response, the controller 110 causes the stepping motor 100 to start rotating and thereby causes the feed roller 32 to rotate clockwise. At the same time, the pick-up roller 30 driven in the same direction as the feed roller 32 pays out the top sheet 3. The reverse roller 34 cooperates with the feed roller 32 to separate the top sheet 3 from the underlying sheets 3. The leading edge of the top sheet 3 abuts against the nip between the registration rollers 33*a* and 33*b*. As soon as the sheet 3 being further conveyed forms a preselected amount of slack 3A upward, as shown in FIG. 12, the rotation of the feed roller 32 and pick-up roller 30 is interrupted.

In the illustrative embodiment, the sheet 3 is fed by a distance which is 5 mm to 6 mm greater than the distance between the nip between the registration rollers 33*a* and 33*b* and the front plate 35. The controller 110 converts such an amount of feed to a number of steps and feeds a command representative of the number of steps to the stepping motor 100. As a result, the sheet 3 is fed by the feed roller 32 by an amount great enough to form the slack 3A.

Figure 13:
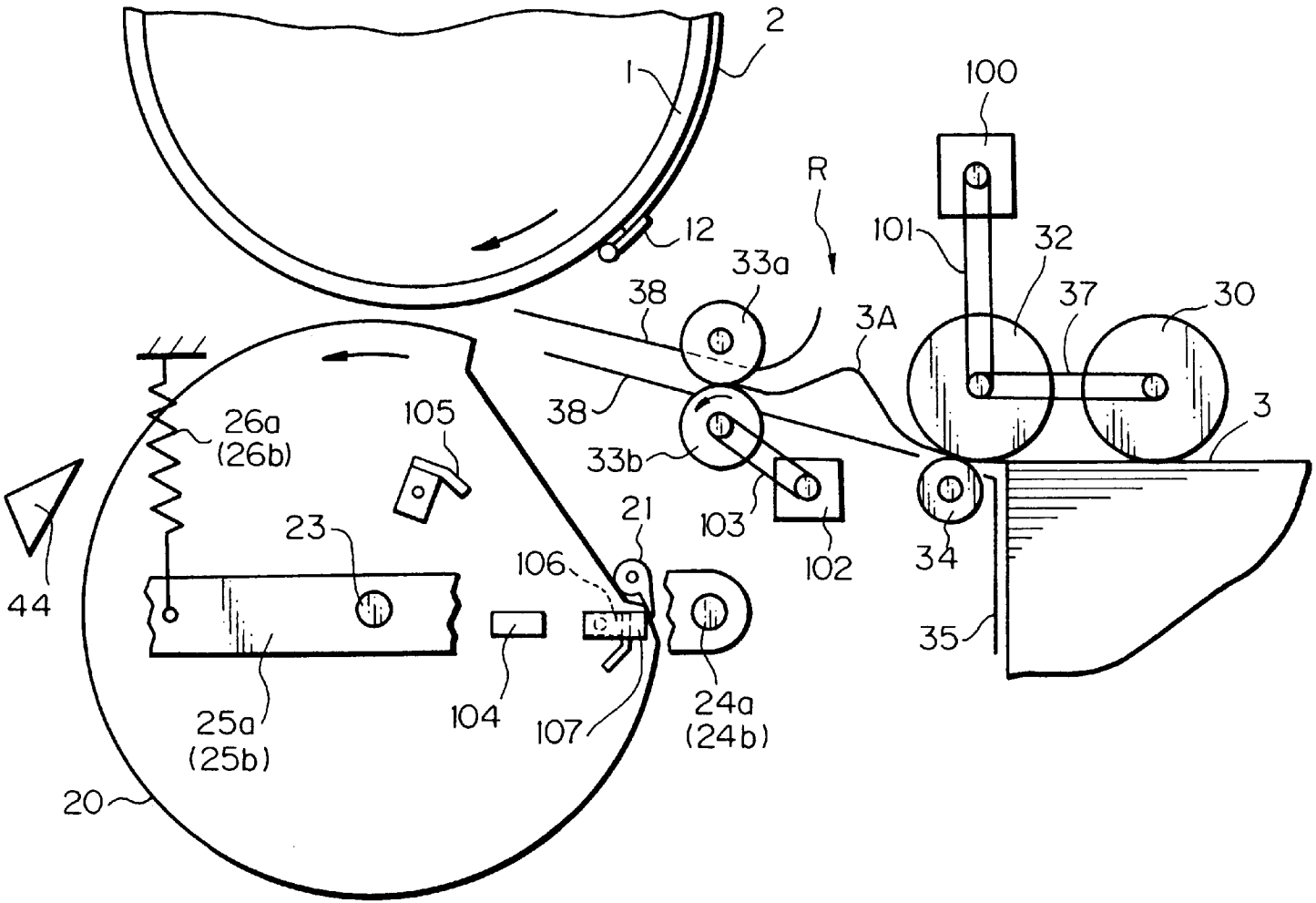
FIG. 13 is a front view showing how the registration roller conveys the sheet just after it has been driven.
Figure 14:
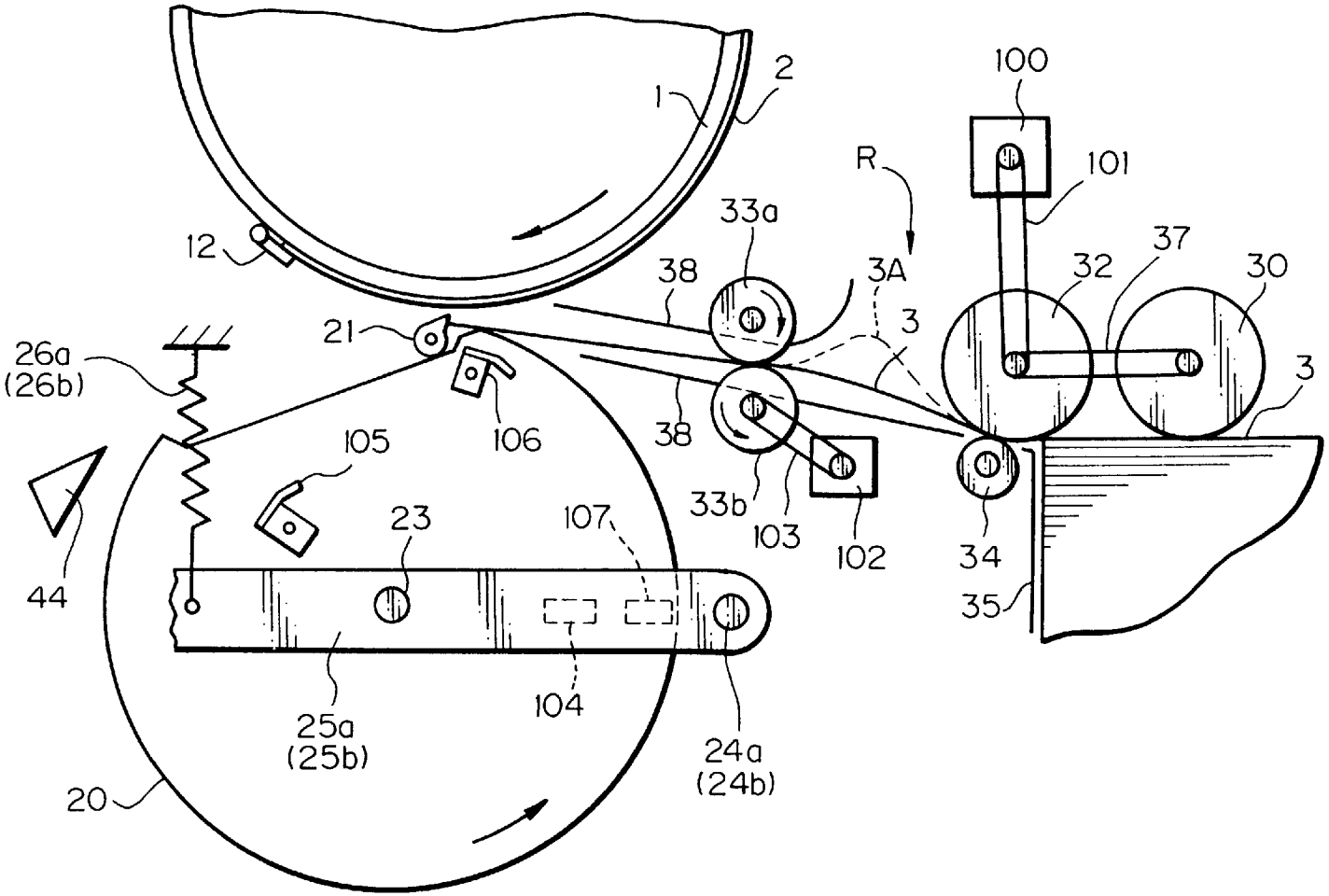
FIG. 14 is a front view demonstrating the transport of the leading edge of the sheet to the sheet clamper included in the embodiment.

As shown in FIG. 13, while the press drum 20 is further rotated counterclockwise, the interrupter 106 meets the photosensor 107 and causes it to send an ON signal to the controller 110. As shown in FIG. 10, the controller 110 sends, on the elapse of a preselected delay time Dt, a command to the stepping motor 102 and causes it to start rotating. As a result, the registration roller 33*b* is rotated counterclockwise. Consequently, as shown in FIG. 14, the slack 3A of the sheet 3 disappears. The leading edge of the sheet 3 is conveyed toward the sheet clamper 21 of the press drum 20 with the feed roller 32 and pick-up roller 30 being rotated by the sheet 3.

As shown in FIG. 14, as soon as the leading edge of the sheet 3 abuts against the sheet clamper 21 held in its open position, the clamper 21 catches the sheet 3 and closes. The press drum 20 rotates while retaining the sheet 3 thereon and conveys the leading edge of the sheet 3 toward the gap between the drum 20 and the print drum 1. At this instant, the controller 110 sends the command to the stepping motor 102 such that the sheet 3 is fed at a speed about 1.1 times as high as the peripheral speed of the press drum 20.

Because the registration roller 33*b* is rotated by the stepping motor 102 via the toothed endless belt 103, it may occur that the rotation of the roller 33*b* is delayed due to, e.g., the slack of the belt 103. In light of this, the feed speed assigned to the stepping motor 102 is selected to be higher than the peripheral speed of the press drum 20 so as to correct the above delay. Even after this correction, the sheet 3 being conveyed at the speed higher than the peripheral speed of the press drum 20 arrives at the clamping position earlier than expected, jamming the transport path. This is why the controller 110 causes the stepping motor 102 to start rotating on the elapse of the delay time Dt mentioned earlier. In this manner, the illustrative embodiment causes the sheet 3 to be fed at a speed higher than the peripheral speed of the press drum 20, but sets the delay time Dt. This successfully compensates for scattering among machines, e.g., plays in drivelines and allows the sheet clamper 21 to surely clamp the leading edge of the sheet 3 at its clamping position.

Figure 15:
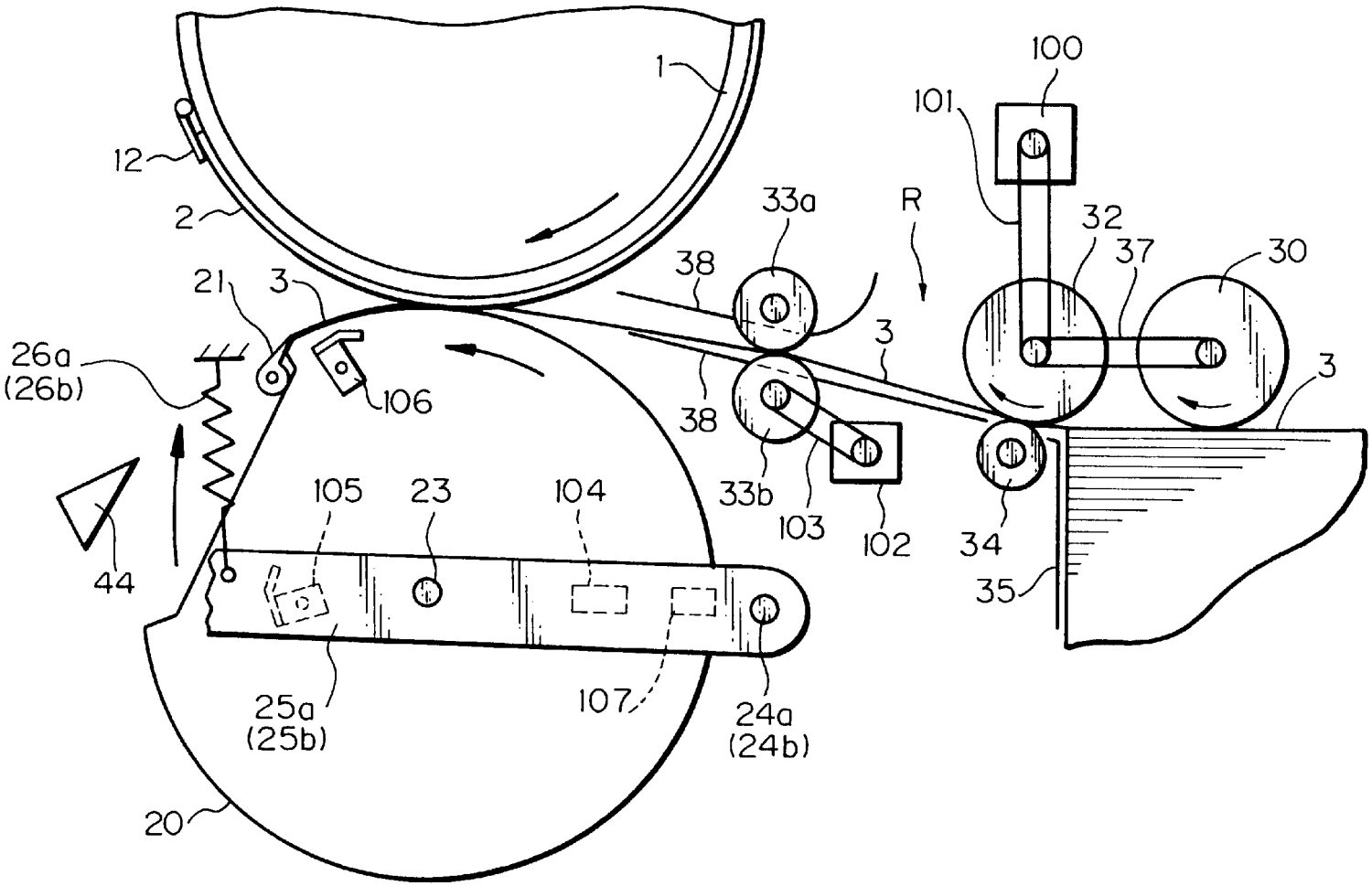
FIG. 15 is a front view showing the transport of the sheet occurring in the embodiment at the initial stage of printing operation.

As shown in FIG. 15, the press drum 20 is moved upward by the springs 26*a* and 26*b* included in the moving means until it presses itself against the print drum 1 and forms a nip. As a result, the sheet 3 is pressed against the print drum 1 by the press drum 20.

While the sheet 3 is sequentially pressed against the master 2 wrapped around the drum print 1 in rotation, the master 2 is brought into close contact with the drum 1. Consequently, the ink oozes out from the porous portion of the print drum 1 to the perforations of the master 2. The ink is transferred from the master 2 to the sheet 3, printing the document image on the sheet 3.

During the printing operation, the ink roller 13 is rotated in the same direction as the print drum 1. The ink in the ink well 16 is deposited on the ink roller 13 due to the rotation of the roller 13. The doctor roller 15 regulates the amount of the ink deposited on the ink roller 13. The ink is therefore fed to the inner periphery of the drum 1 in such a regulated amount.

The sheet clamper 21 is opened when it is brought to a position short of the separator 44 by the press drum 20. The sheet 3 is separated from the press drum 20 by the separator 44 and then conveyed to the tray 45 by the belt 48 to turn out a trial printing. At the same time, the press drum 20 is released from the print drum 1, again setting up the initial condition.

The operator examines the trial printing so as to confirm the quality, position and other conditions of the image. If the trial printing is acceptable, the operator causes the printer to repeat the above sheet feeding, printing and sheet discharging steps a number of times corresponding to a desired number of printings.

In the above embodiment, the controller 110 energizes the stepping motor 102 on the elapse of the delay time Dt after the receipt of the ON signal from the photosensor 107. An alternative arrangement will be described with reference to FIG. 7.

As shown in FIG. 7, the alternative arrangement includes an electromagnetic clutch 122 (dash-and-dots line) intervening between the shaft of the registration roller 33*b* and the associated pulley. When the clutch 122 is coupled, the pulley for registration is connected to the shaft of the registration roller 33*b*, transferring the rotation of the stepping motor 102 to the roller 33*b*. As a result, the registration roller 33*b* is rotated counterclockwise while the registration roller 33*a* is rotated clockwise by the sheet 3 being conveyed. When the clutch 122 is uncoupled, it interrupts the drive transmission between the stepping motor 102 and the registration roller 33*b*.

On receiving the ON signal from the photosensor 104 responsive to the interrupter 105, the controller 110 energizes the stepping motors 100 and 102. At this instant, the clutch 122 is held in its uncoupled position and prevents the registration roller 33*b* from rotating counterclockwise.

On receiving the ON signal from the photosensor 107 responsive to the interrupter 106, the controller 110 couples the clutch 122 with the result that the registration roller 33*b* rotates counterclockwise and conveys the leading edge of the sheet 3.

The illustrative embodiment described above achieves the following various advantages. The interrupter 106 and photosensor 107 for determining the timing for feeding the leading edge of the sheet 3 to the sheet clamper 21 are arranged on the press drum 20. This allows the sheet clamper 21 to surely clamp the leading edge of the sheet 3 and prevents the sheet 3 from rolling up. In addition, the sheet 3 can be fed stably and reliability and can therefore be brought into accurate registration.

A delay time is provided between the time when the photosensor 107 responsive to the interrupter 106 starts outputting an ON signal and the time when the stepping motor 102 begins to be driven. The delay time facilitates control using software and compensates for scattering among machines including plays in drivelines.

The stepping motor 102 implementing the registration roller drive means eliminates the need for mechanical parts for braking the registration roller and limiting the direction of rotation of the registration roller, and thereby reduces the cost. The driveline for driving the registration rollers 33*a* and 33*b* is provided independently of the main motor used to drive the print drum 1 and press drum 20. This not only reduces the load on the drive system, but also promotes the use of a small capacity, inexpensive main motor.

The interrupter 105 and photosensor 104 for determining the timing for the leading edge of the sheet 3 to be fed to the registration rollers 33*a* and 33*b* are also arranged on the press drum 20. This also allows the sheet 3 to be fed stably and reliably.

The stepping motor 100 implementing the feed roller drive means eliminates the need for mechanical parts for limiting the direction of rotation of the feed roller, and thereby reduces the cost. The driveline for driving the feed rollers 32 and pick-up roller 30 is provided independently of the main motor used to drive the print drum 1 and press drum 20. This not only reduces the load on the drive system, but further promotes the use of a small capacity, inexpensive main motor.

Figure 16:
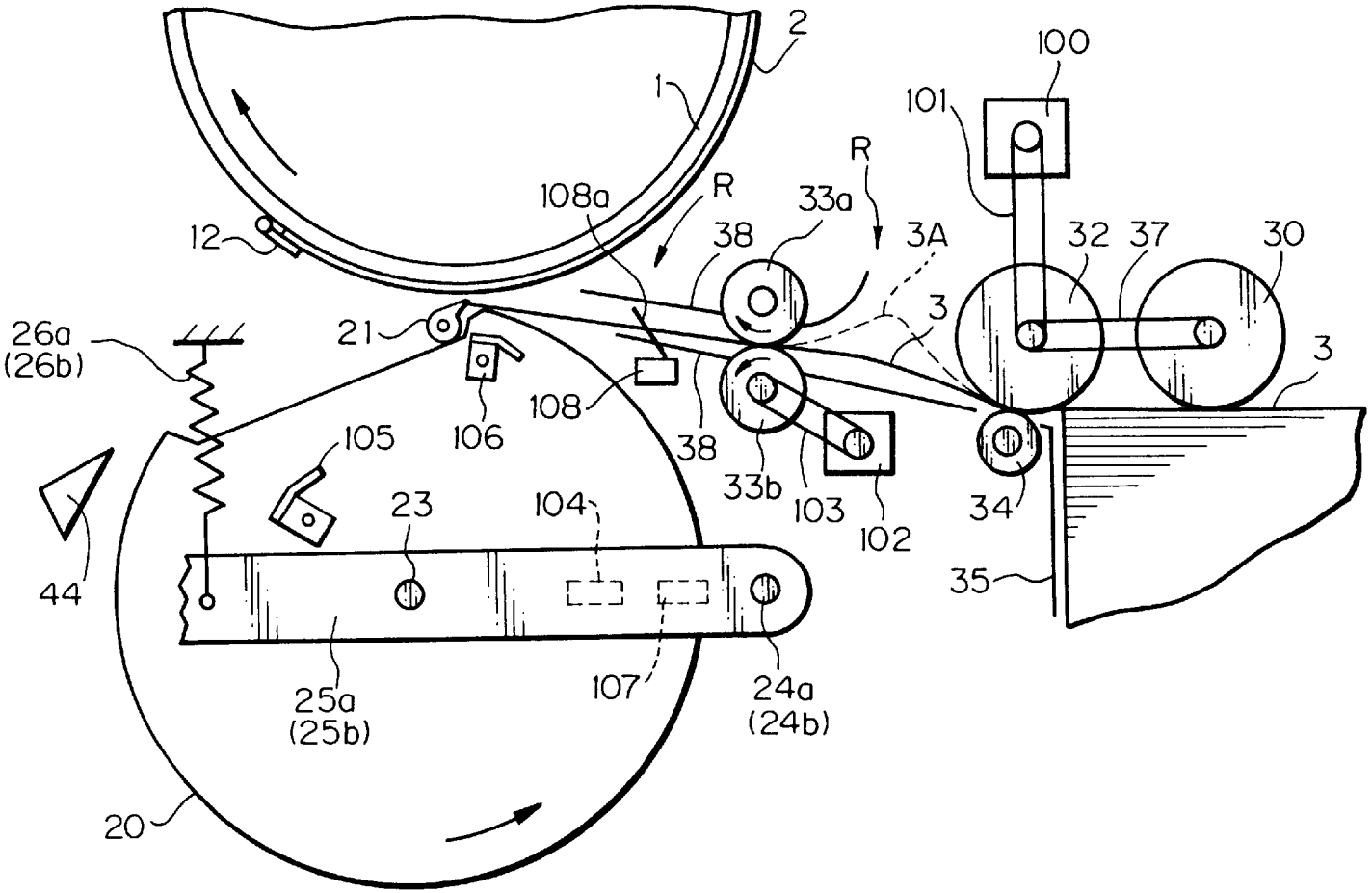
FIG. 16 is a front view showing an alternative embodiment of the present invention.

Reference will be made to FIGS. 9 and 16 for describing an alternative embodiment of the present invention. The alternative embodiment is similar to the above embodiment except for the following. As shown in FIGS. 9 and 16, the photosensor 108 with a feeler mentioned earlier is positioned on the sheet transport path R between the press drum 20 and the registration rollers 33*a* and 33*b* and play the role of leading edge sensing means responsive to the leading edge of the sheet 3. In response to the output of the photosensor 108, the controller 110 drives the stepping motor 102 such that the leading edge of the sheet 3 is fed at the same time as the arrival of the sheet clamper 21 at its clamping position, taking account of the slippage of the sheet 3 on the registration rollers 33*a* and 33*b*.

The photosensor 108 is fixed at a preselected position on the sheet transport path R between the press drum 20 and the registration rollers 33*a* and 33*b*. A feeler 108*a* protrudes from the body of the photosensor 108. When the leading edge of the sheet 3 being conveyed contacts one end of the feeler 108*a*, the other end of the feeler 108*a* angularly moves and interrupts an optical path between the light emitting portion and the light-sensitive portion of the photosensor 108. As a result, the photosensor 108 senses the leading edge of the sheet 3.

The friction acting between the sheet 3 and the registration rollers 33*a* and 33*b* depends on the quality, thickness and other factors of the sheet 3. In the alternative embodiment, even when the sheet 3 being conveyed by the registration rollers 33*a* and 33*b* slips due to the above factors, a difference in the position of the leading edge of the sheet 3 ascribable to the slippage is detected and used to correct the slippage, as will be described hereinafter. This allows the leading edge of the sheet 3 to be surely conveyed to the sheet clamper 21.

Specifically, the distance between the photosensor 108 and the nip between the registration rollers 33*a* and 33*b* is fixed beforehand. It follows that the number of pulses of the stepping motor 102 for rotating the registration roller 33*b* in order to convey the sheet 3 over the above distance is constant. For example, assume that the photosensor 108 does not turn on even when the motor 102 reaches the preselected number of pulses after the rotation of the registration roller 33*b*, meaning that the sheet 3 has slipped, due to a change in the quality of the sheet 3. Then, the controller 110 sends a command to the motor 102 such that the sheet 3 is conveyed by an additional amount corresponding to a difference between the preselected number of pulses and the number of pulses at which the photosensor 108 actually turns on. This allows the leading edge of the sheet 3 to surely abut against the sheet clamper 21 without regard to the quality or thickness of the sheet 3.

As stated above, in the alternative embodiment, the photosensor 108 with the feeler 108*a* allows the controller 110 to control the stepping motor 102 such that the leading edge of the sheet 3 is fed in synchronism with the arrival of the sheet clamper 21 to its clamping position, taking account of the slippage of the sheet 3 on the registration rollers 33*a* and 33*b*. This further promotes the accurate feed of the leading edge of the sheet 3 to the sheet clamper 21 brought to its clamping position, and thereby further enhances the registration accuracy.

In the illustrative embodiment and its modification, the print drum 1 and press drum 20 are assumed to have the same outside diameter. The outside diameters, however, may not be exactly the same, but may include some tolerance in design. While the press drum 20 has been shown and described as being pressed against the print drum 1, the print drum 1 may be pressed against the press drum 20, or even both of the drums 1 and 20 may be pressed against each other. To press the print drum 1 against the press drum 20, the print drum 1 (or the ink roller 13 disposed in the drum 1) may be moved toward the press drum 20. When the press drum 20 is pressed against the print drum 1, the timing sensing means are arranged on the press drum 20 or a member movable substantially in synchronism with the drum 20 toward the drum 1. When the print drum 1 is pressed against the press drum 20, the timing sensing means are arranged on the press drum 20 or the portion of the printer body adjoining the drum 20. While the timing sensing means are implemented by transmission type or photointerrupter type photosensors and interrupters in the embodiment and its modification, use may be made of reflection type photosensors or microswitches with mechanical contacts if stable and reliable sensing is not of primary importance. The registration roller drive control means and feed roller drive control means may advantageously be implemented by a microcomputer or a microprocessor.

In summary, it will be seen that the present invention provides a printer having various unprecedented advantages, as follows. A sheet clamper is capable of surely clamping the leading edge of a sheet and preventing it from rolling up. The sheet can be fed stably and reliability and can therefore be brought into accurate registration.

Scattering among machines can be easily compensated for, and easy control using software is promoted.

Mechanical parts for braking registration rollers and limiting the direction of rotation of the roller are not necessary, so that the cost of the printer is reduced. A driveline for driving the registration rollers is provided independently of a main motor used to drive a print drum and pressing means (press drum or the like). This not only reduces a load on the drive system, but also promotes the use of a small capacity, inexpensive main motor.

Mechanical parts for limiting the direction of rotation of a roller are not necessary, so that the cost of the printer is further reduced. Moreover, a driveline for driving the feed roller is provided independently of the main motor used to drive the print drum and pressing means. This not only reduces the load on the drive system, but further promotes the use of a small capacity, inexpensive main motor.

Because the slippage of the sheet on the registration rollers are compensated for without regard to the kind of the sheet (quality, thickness etc.), the leading edge of the sheet can be more surely driven to the position where clamping means is located. This further enhances registration accuracy.

Various modifications will become possible for those skilled in the art after receiving the teachings of the present disclosure without departing from the scope thereof.

What is claimed is:

1. A printer for printing an image on a sheet by pressing the sheet against a master, comprising:

a print drum for wrapping the master therearound;

a press drum having substantially a same outside diameter as said print drum for pressing the sheet relatively against said print drum, said press drum including sheet clamping means for clamping a leading edge of the sheet; and timing sensing means for determining a timing for feeding the leading edge of the sheet toward said sheet clamping means by sensing a predetermined angular position of said press drum relative to a fixed angular position thereof.

2. A printer as claimed in claim 1, wherein said timing sensing means is arranged on either one of said press drum or a member associated with said press drum.

3. A printer as claimed in claim 2, further comprising:

a registration roller for conveying the leading edge of the sheet toward said sheet clamping means;

registration roller drive means for causing said registration roller to rotate; and registration roller drive control means for controlling, in response to an output of said timing sensing means, said registration roller drive means such that the leading edge of the sheet is fed at a timing matching with said angular position of said sheet clamping means.

4. A printer as claimed in claim 3, wherein a delay time is provided between a time when said timing sensing means starts outputting an ON signal and a time when said registration roller drive means begins to be driven.

5. A printer as claimed in claim 3, wherein said registration roller drive means comprises a stepping motor.

6. A printer as claimed in claim 3, further comprising leading edge sensing means for sensing the leading edge of the sheet on a sheet transport path between said press drum and said registration roller, said registration roller drive control means controlling said registration roller drive means such that the leading edge of the sheet is fed at said timing, taking account of a slippage of the sheet on said registration roller.

7. A printer as claimed in claim 1, further comprising a registration roller for feeding the leading edge of the sheet toward said sheet clamping means, and sheet feed timing sensing means for determining a timing for the leading edge of the sheet to be fed toward said registration roller.

8. A printer as claimed in claim 7, wherein said sheet feed timing sensing means is arranged on either one of said press drum or a member associated with said press drum.

9. A printer as claimed in claim 8, further comprising:

a feed roller for feeding the leading edge of the sheet toward said registration roller while separating the sheet from other sheets;

feed roller drive means for causing said feed roller to rotate; and feed roller drive control means for controlling, in response to an output of said sheet feed timing sensing means, said feed roller drive means such that the leading edge of the sheet is fed toward said registration roller.

10. A printer as claimed in claim 9, wherein said feed roller drive means comprises a stepping motor.

11. A printer as claimed in claim 1, wherein said timing sensing means, in response to the sensing of angular position of said press drum, controls the feeding of said sheet toward said sheet clamping means.

12. A printer for printing an image on a sheet by pressing the sheet against a master, comprising:

a print drum for wrapping the master therearound;

a press drum having substantially a same outside diameter as said print drum for pressing the sheet relatively against said print drum, said press drum including sheet clamping means for clamping a leading edge of the sheet;

a registration roller for feeding the leading edge of the sheet toward said sheet clamping means;

a feed roller for feeding the leading edge of the sheet toward said registration roller while separating the sheet from other sheets; and sheet feed timing sensing means for determining a timing for feeding the leading edge of the sheet toward said registration roller by sensing a predetermined angular position of said press drum relative to a fixed angular position thereof.

13. A printer as claimed in claim 12, wherein said sheet feed timing sensing means is arranged on either one of said press drum or a member associated with said press drum.

14. A printer as claimed in claim 13, further comprising:

a feed roller for feeding the leading edge of the sheet toward said registration roller while separating the sheet from other sheets;

feed roller drive means for causing said feed roller to rotate; and feed roller drive control means for controlling, in response to an output of said sheet feed timing sensing means, said feed roller drive means such that the leading edge of the sheet is fed toward said registration roller.

15. A printer as claimed in claim 14, wherein said feed roller drive means comprises a stepping motor.

16. A printer as claimed in claim 11, wherein said sheet feed timing sensing means, in response to the sensing of angular position of said press drum, controls said feed roller to control the feeding of said sheet toward said registration roller.

* * * * *